US009991032B2

(12) United States Patent
Wang

(10) Patent No.: US 9,991,032 B2
(45) Date of Patent: Jun. 5, 2018

(54) METHOD FOR MANUFACTURING THIN FILM CHIP RESISTOR DEVICE

(71) Applicant: RALEC ELECTRONIC CORPORATION, Kaohsiung (TW)

(72) Inventor: Wan-Ping Wang, Kaohsiung (TW)

(73) Assignee: RALEC ELECTRONIC CORPORATION, Kaohsiung (TW)

( * ) Notice: Subject to any disclaimer, the term of this patent is extended or adjusted under 35 U.S.C. 154(b) by 257 days.

(21) Appl. No.: 14/946,155

(22) Filed: Nov. 19, 2015

(65) Prior Publication Data

US 2016/0351307 A1 Dec. 1, 2016

(30) Foreign Application Priority Data

May 29, 2015 (TW) ..... 104117423 A

(51) Int. Cl.

| | |
|---|---|
| ***H01C 17/00*** | (2006.01) |
| ***H01C 17/08*** | (2006.01) |
| ***H01C 17/28*** | (2006.01) |
| ***H01C 7/00*** | (2006.01) |
| *B05D 5/00* | (2006.01) |
| *B05C 11/00* | (2006.01) |
| *B05D 1/32* | (2006.01) |
| *H01C 7/06* | (2006.01) |

(52) U.S. Cl.

CPC ..... *H01C 17/006* (2013.01); *H01C 7/006* (2013.01); *H01C 17/08* (2013.01); *H01C 17/28* (2013.01); *B05C 11/00* (2013.01); *B05D 1/32* (2013.01); *B05D 5/00* (2013.01); *H01C 7/06* (2013.01)

(58) Field of Classification Search

CPC ..... B05C 11/00; B05C 14/04; B05D 1/32; B05D 5/00; H01C 7/006; H01C 7/06; H01C 17/006; H01C 17/08; H01C 17/28

See application file for complete search history.

(56) References Cited

U.S. PATENT DOCUMENTS 5,604,383 A * 2/1997 Matsuzaki ..... G06K 19/0723 257/691
5,699,025 A * 12/1997 Kanoh ..... H01L 27/016 257/E27.116
7,420,786 B2 * 9/2008 Sugiyama ..... G11C 11/161 360/322

(Continued)

FOREIGN PATENT DOCUMENTS

JP 4013858 A * 1/1992

*Primary Examiner* — Carl Arbes

(74) *Attorney, Agent, or Firm* — Muncy, Geissler, Olds & Lowe, P.C.

(57) ABSTRACT

A method for manufacturing a thin film chip resistor device includes the steps of: disposing a magnetic fixing member on a first surface of a substrate, and disposing a magnetic shadow mask on a second surface of the substrate opposite to the first surface, such that the magnetic shadow mask detachably and fixedly contacts the second surface of the substrate by virtue of an attractive magnetic force between the magnetic fixing member and the magnetic shadow mask; and depositing at least one resistor unit on the second surface of the substrate with the use of the magnetic shadow mask, the resistor unit including two separated first electrode elements and a resistor element that electrically interconnects the first electrode elements.

18 Claims, 9 Drawing Sheets

(56) References Cited

U.S. PATENT DOCUMENTS

2007/0247268 A1* 10/2007 Oya ..... H01F 17/0006
336/200
2008/0107873 A1* 5/2008 Kuwajima ..... H01G 2/065
428/195.1

* cited by examiner

METHOD FOR MANUFACTURING THIN FILM CHIP RESISTOR DEVICE

CROSS-REFERENCE TO RELATED APPLICATION

This application claims priority of Taiwanese Patent Application No. 104117423, filed on May 29, 2015.

FIELD

The disclosure relates to a method for manufacturing a resistor device, more particularly to a method for manufacturing a thin film chip resistor device.

BACKGROUND

Resistors are used for reducing voltage or limiting current flow. Chip resistor devices can generally be classified into thick film chip resistor devices and thin film chip resistor devices. The thick film chip resistor devices normally have a film thickness larger than 5 μm and are usually made by silk screen printing techniques. The thin film chip resistor devices normally have a film thickness smaller than 1 μm and are usually made by chemical vapor deposition techniques or physical vapor deposition techniques such as vacuum evaporation, magnetron sputtering, etc., in combination with photolithography.

During photolithography, a resistor layer is first formed on a substrate, followed by etching the resistor layer with the use of a patterned photoresist to obtain a chip resistor device with a desired resistor value. However, a developer used in the photolithography process is toxic and may be harmful to equipment operators and the environment. Moreover, the equipment and maintenance costs are rather high.

In an alternative method, a mask with a predetermined pattern is formed on a substrate by screen printing techniques, followed by depositing a resistor layer on the substrate. However, the mask formed by screen printing techniques tends to deform and cause an undesired resistor value shift. Furthermore, the mask must be removed by use of chemicals, which contributes to increased levels of environmental pollution.

SUMMARY

Therefore, an object of the present disclosure is to provide a method for manufacturing a thin film chip resistor device that can alleviate at least one of the aforementioned drawbacks associated with the conventional method.

According to an aspect of the present disclosure, a method for manufacturing a thin film chip resistor device includes the steps of:

disposing a magnetic fixing member on a first surface of a substrate, and disposing a magnetic shadow mask on a second surface of the substrate opposite to the first surface, such that the magnetic shadow mask detachably and fixedly contacts the second surface of the substrate by virtue of an attractive magnetic force between the magnetic fixing member and the magnetic shadow mask; and depositing at least one resistor unit on the second surface of the substrate with the use of the magnetic shadow mask, the resistor unit including two separated first electrode elements and a resistor element that electrically interconnects the first electrode elements.

BRIEF DESCRIPTION OF THE DRAWINGS

Other features and advantages of the present disclosure will become apparent in the following detailed description of the embodiments with reference to the accompanying drawings, of which.

DETAILED DESCRIPTION

Figure 1:
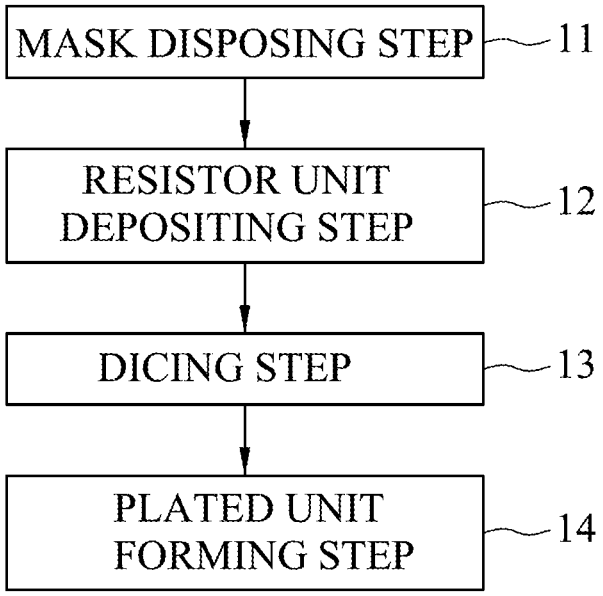
FIG. 1 is a flow chart illustrating a first embodiment of a method for manufacturing a thin film chip resistor device according to the present disclosure.

Before the disclosure is described in further detail with reference to the accompanying embodiments, it should be noted herein that like elements are denoted by the same reference numerals throughout the disclosure.

Referring to FIGS. 1 to 5, a first embodiment of a method for manufacturing multiple thin film chip resistor devices 5 according to the present disclosure includes a mask disposing step 11, a resistor unit depositing step 12, a dicing step 13 and a plated unit forming step 14.

Figure 2:
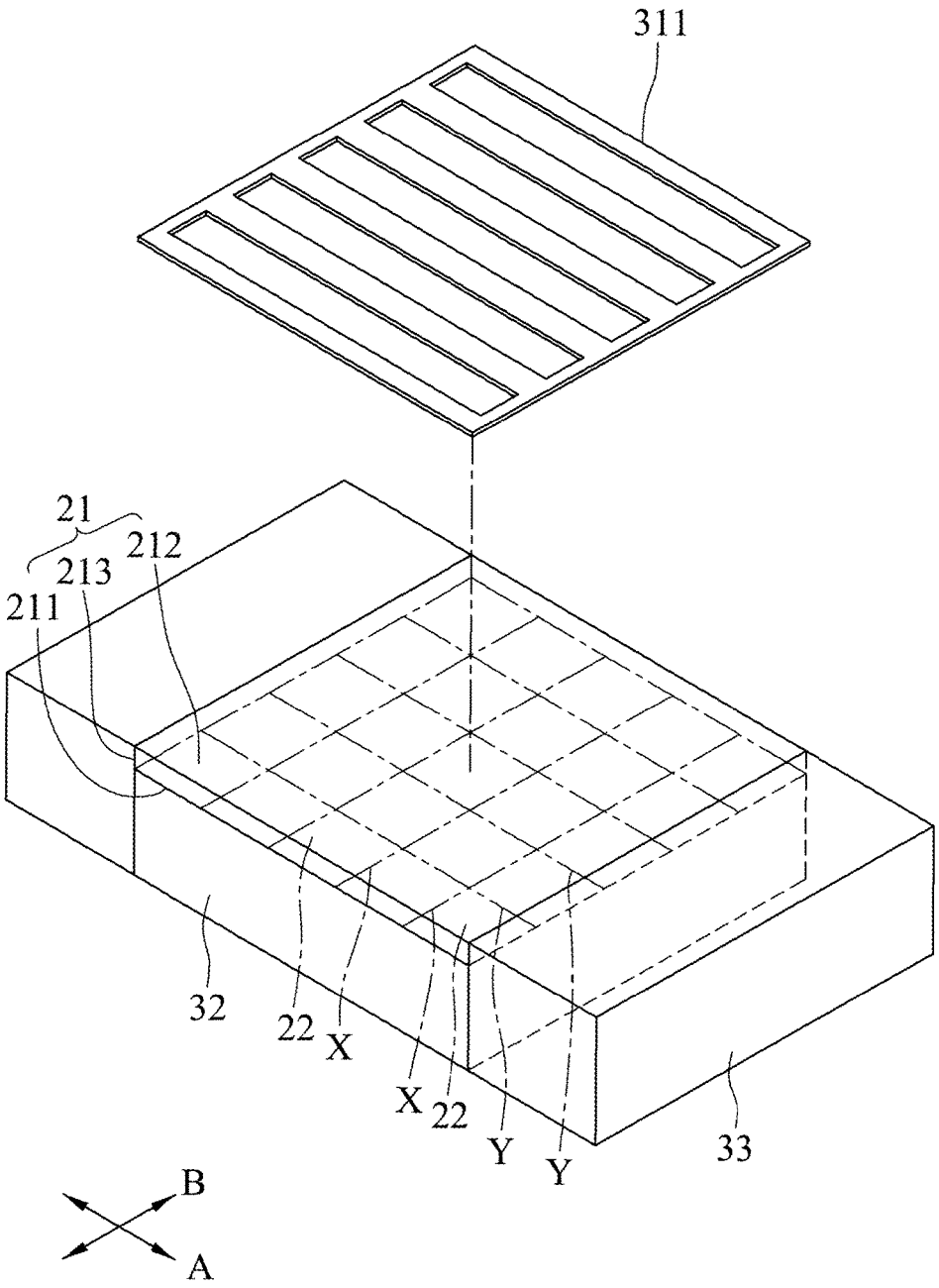
FIG. 2 is a schematic view showing a step of forming a plurality of resistor elements in the first embodiment.

Referring to FIG. 2, a substrate 21 is firstly provided. The substrate 21 has a first surface 211, a second surface 212 opposite to the first surface 211, and a side surface 213 interconnecting the first and second surfaces 211, 212. The substrate 21 is defined with a plurality of first imaginary dicing lines (X) that are separated from one another along a first direction (A), and a plurality of second imaginary dicing lines (Y) that are separated from one another along a second direction (B) and that intersect the first imaginary dicing lines (X) to define a plurality of substrate units 22.

Next, in the mask disposing step 11, a magnetic fixing member 32 is disposed on the first surface 211 of the substrate 21, and a first magnetic shadow mask 311 is disposed on the second surface 212 of the substrate 21, such that the first magnetic shadow mask 311 detachably and fixedly contacts the second surface 212 of the substrate 21 by virtue of the attractive magnetic force between the magnetic fixing member 32 and the first magnetic shadow mask 311. Afterwards, the magnetic fixing member 32, the first magnetic shadow mask 311 and the substrate 21 are fixed with the fixture unit 33.

Figure 3:
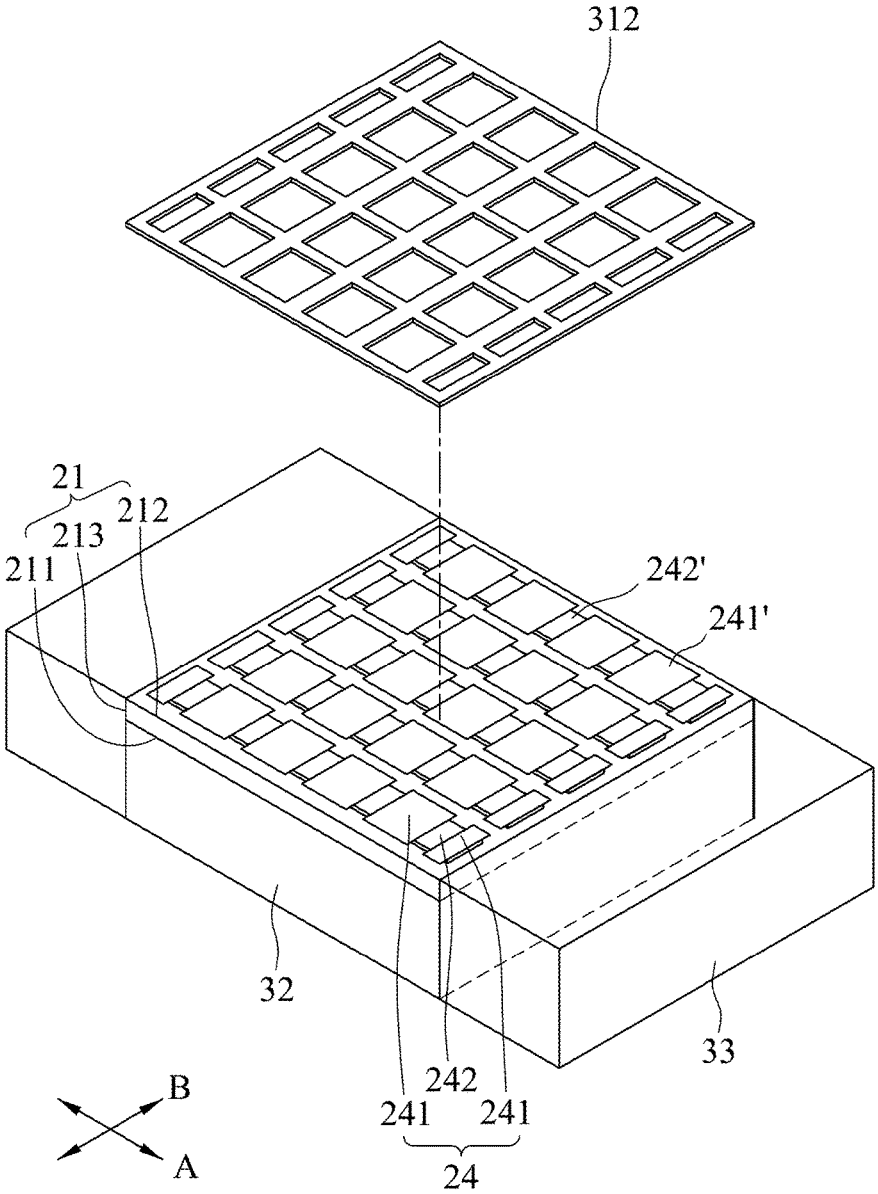
FIG. 3 is a schematic view showing a step of forming a plurality of electrode elements in the first embodiment.

In the resistor unit depositing step 12, at least one resistor unit 24 is deposited on the second surface 212 of the substrate 21. The resistor unit 24 includes two separated first electrode elements 241 and a resistor element 242 electrically interconnecting the first electrode elements 241. In this embodiment, a plurality of resistor units 24 are deposited on the second surface 212. Specifically, as shown in FIGS. 2 and 3, in this embodiment, a plurality of separated resistor strips 242' (to be formed into the resistor elements 242 of the resistor units 24) are formed on the second surface 212 of the substrate 21 with the use of the first magnetic shadow mask 311. The resistor strips 242' are arranged along the second direction (B) and extend in the first direction (A). Afterwards, the fixture unit 33 and the first magnetic shadow mask 311 are removed sequentially.

Next, as shown in FIG. 3, a second magnetic shadow mask 312 having a pattern different from that of the first magnetic shadow mask 311 is disposed on the second surface 212 of the substrate 21, such that the second magnetic shadow mask 312 detachably and fixedly contacts the second surface 212 of the substrate 21 by virtue of the attractive magnetic force between the magnetic fixing member 32 and the second magnetic shadow mask 312. Then, the magnetic fixing member 32, the second magnetic shadow mask 312 and the substrate 21 are fixed with the fixture unit 33. Subsequently, a plurality of electrode pads 241' (to be formed into the electrode elements 241 of the resistor units 24) are formed on the resistor strips 242' with the use of the second magnetic shadow mask 312 so as to form an assembly composed of the substrate 21, the resistor strips 242' and the electrode pads 241'. The electrode pads 241' are arranged in a matrix form such that a part of the regions of each of the resistor strips 242' are exposed. With such arrangement, each of the substrate units 22 is formed thereon the resistor unit 24 containing the two electrode elements 241 and the resistor element 242 interconnecting the two electrode elements 241. Note that the detailed structure of the resistor units 24 is well-known in the art and is therefore not further elaborated hereinafter for the sake of brevity.

After the formation of the electrode pads 241', each of the resistor elements 242 may be cut (i.e., by using laser cutting) to obtain a desired resistor value. The adjustment of the resistor value is well-known in the art and additional elaboration thereof will thus not be provided hereinafter for the sake of brevity. It should be noted that, according to practical requirements, the electrode pads 241' may be formed first, followed by forming the resistor strips 242'.

Figure 4:
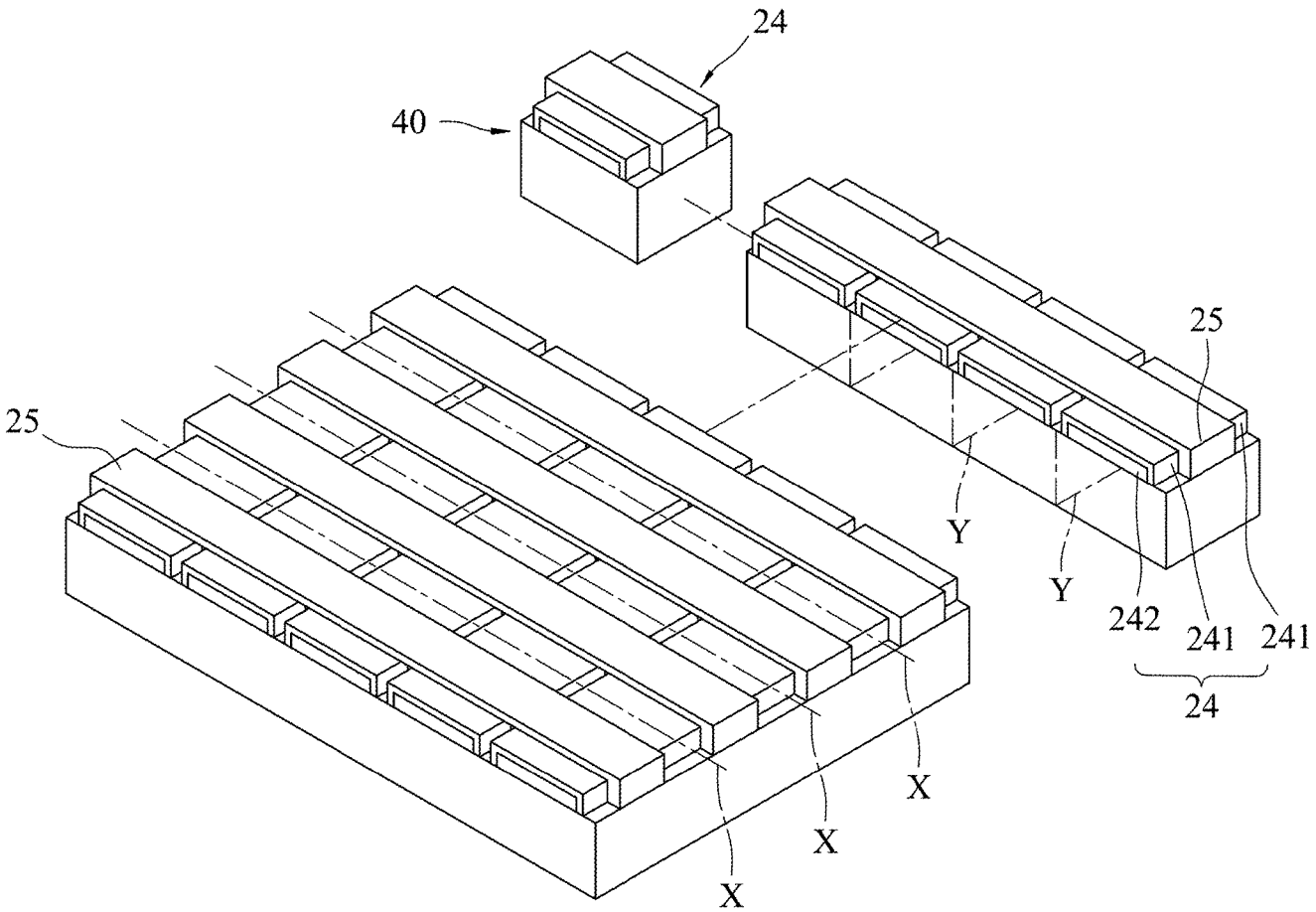
FIG. 4 is a schematic view showing a substrate block and a chip resistor semi-product obtained in the first embodiment.

Referring to FIG. 4, before the dicing step 13, a step of forming a plurality of protective units 25 may be conducted so that the resistor units 24 are covered with the protective units 25. Specifically, an exposed surface of each of the resistor elements 242 may be covered with a respective one of the protective units 25.

In the dicing step 13, the assembly is first diced along the first imaginary dicing lines (X) and the second imaginary dicing lines (Y) so as to form a plurality of chip resistor semi-products 40, each of which includes a respective one of the resistor units 24 (see FIG. 4).

Figure 5:
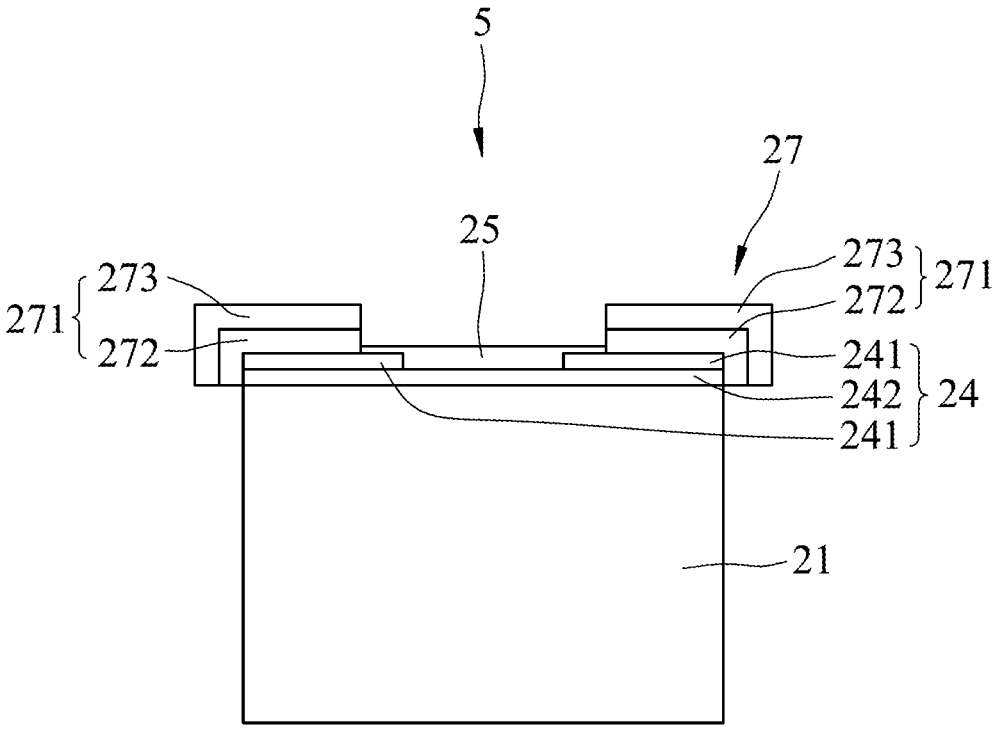
FIG. 5 is a side view of a thin film chip resistor device obtained by the first embodiment.

Referring to FIG. 5, after the dicing step 13, the plated unit forming step 14 is conducted. In the plated unit forming step 14, a plated unit 27 is formed (e.g., by using a barrel plating technique) on the first electrode elements 241 of the resistor unit 24 of a respective one of the chip resistor semi-products 40. The plated unit 27 includes two plated metal laminates 271 each covering and electrically contacting a respective one of the first electrode elements 241. In this embodiment, each of the plated metal laminates 271 is composed of a nickel metal layer 272 and a tin metal layer 273. Note that the plated metal laminate 271 may alternatively be a single-layered structure. The plated unit 27 may protect underlying metal layers from sulfurization, erosion, etc.

Note that each protective unit 25 protects the resistor element 242 of a corresponding resistor unit 24 from collision and contamination in the course of manufacturing. The protective units 25 may be formed after the resistor unit depositing step 12 (as mentioned above) or after the dicing step 13. In each thin film chip resistor device 5, a top surface of the protective unit 25 is lower than a top surface of the plated unit 27, so that the plated metal laminates 271 of the plated unit 27 can be in direct and electrical contact with a circuit board (not shown) without structural hindrance.

It should be pointed out that the first and second magnetic shadow masks 311, 312 may be independently made of a magnetic material, e.g., iron, cobalt or nickel. The magnetic fixing member 32 may be a permanent magnet or a temporary magnet. The shape of the magnetic fixing member 32 may be changed according to the shapes of the first and second magnetic shadow masks 311, 312 so as to achieve superior attractive magnetic force between the magnetic fixing member 32 and the first and second magnetic shadow masks 311, 312. The resistor element 242 of each of the resistor units 24 may be made of a material, e.g., nickel-chromium alloy, nickel-chromium-aluminum alloy, nickel-chromium-silicon alloy, chromium-silicon alloy, manganese-copper-nickel alloy, manganese-copper-tin alloy, or manganese-aluminum alloy. The first electrode elements 241 of each of the resistor units 24 may be made of a material, e.g., silver, copper or gold. The protective units 25 may be made of epoxy resin or acrylic resin.

Note that the magnetic fixing member 32, the magnetic shadow mask and the substrate 21 are fixed with the fixture unit 33 by means of screw locking, interlocking, etc. The fixture unit 33 is used for increasing deposition precision and may be omitted according to practical requirements.

It should be noted that, in the first embodiment, the dicing step 13 may be omitted when manufacturing a single thin film chip resistor device 5 rather than multiple thin film chip resistor devices 5.

Figure 6:
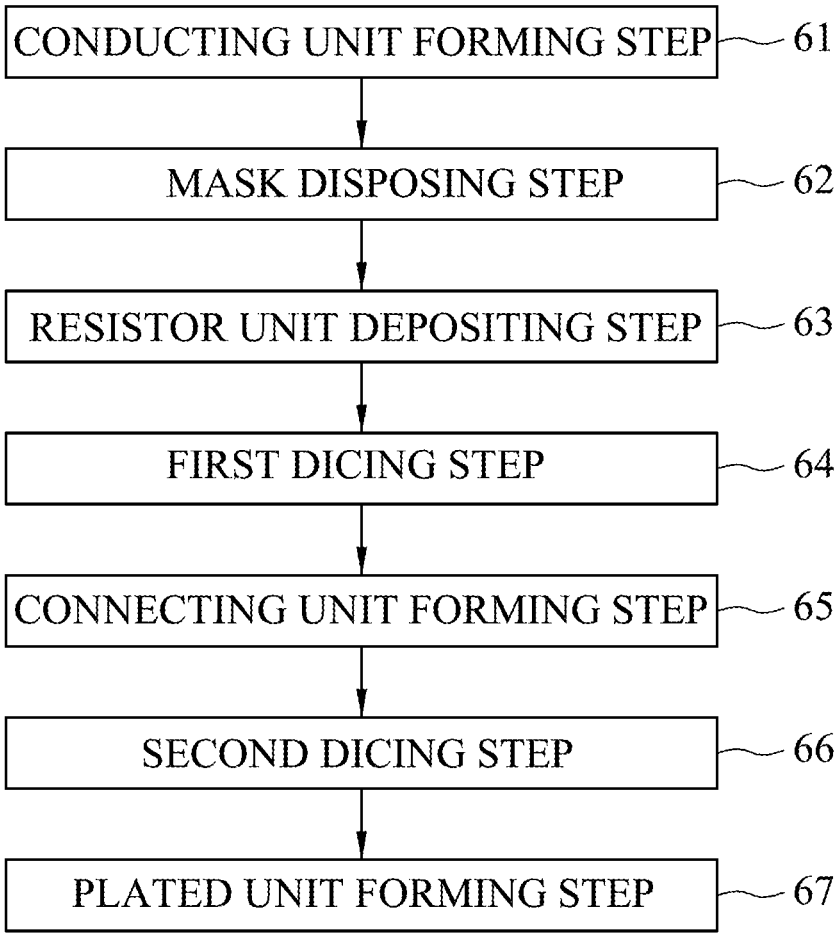
FIG. 6 is a flow chart illustrating a second embodiment of a method for manufacturing a thin film chip resistor device according to the present disclosure.

Referring to FIG. 6, a second embodiment of the method for manufacturing multiple thin film chip resistor devices 7 according to the present disclosure includes a conducting unit forming step 61, a mask disposing step 62, a resistor unit depositing step 63, a first dicing step 64, a connecting unit forming step 65, a second dicing step 66 and a plated unit forming step 67.

The substrate used in the second embodiment has a structure identical to that of the first embodiment.

Figure 7:
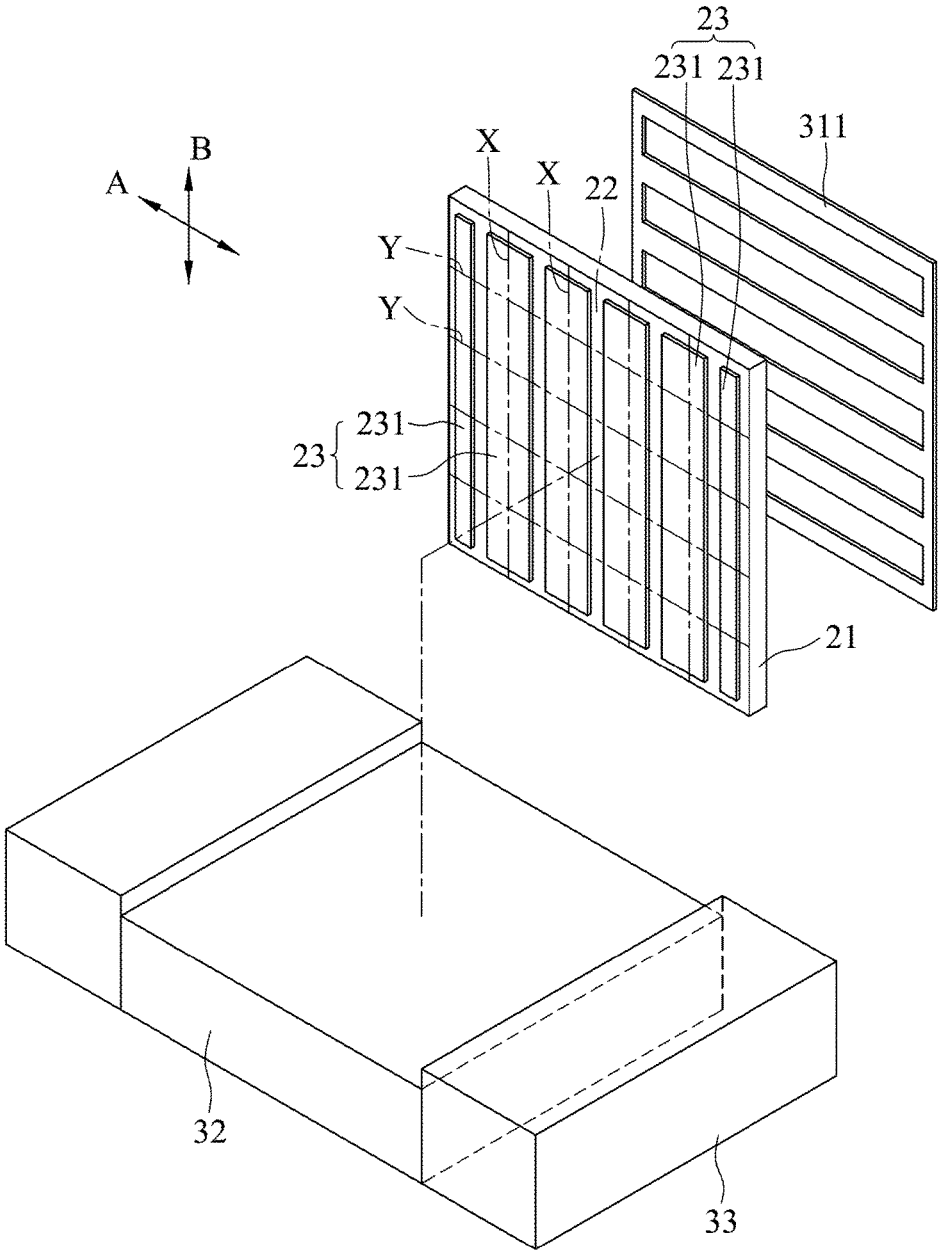
FIG. 7 is a schematic view showing a step of forming a plurality of the resistor elements in the second embodiment.
Figure 8:
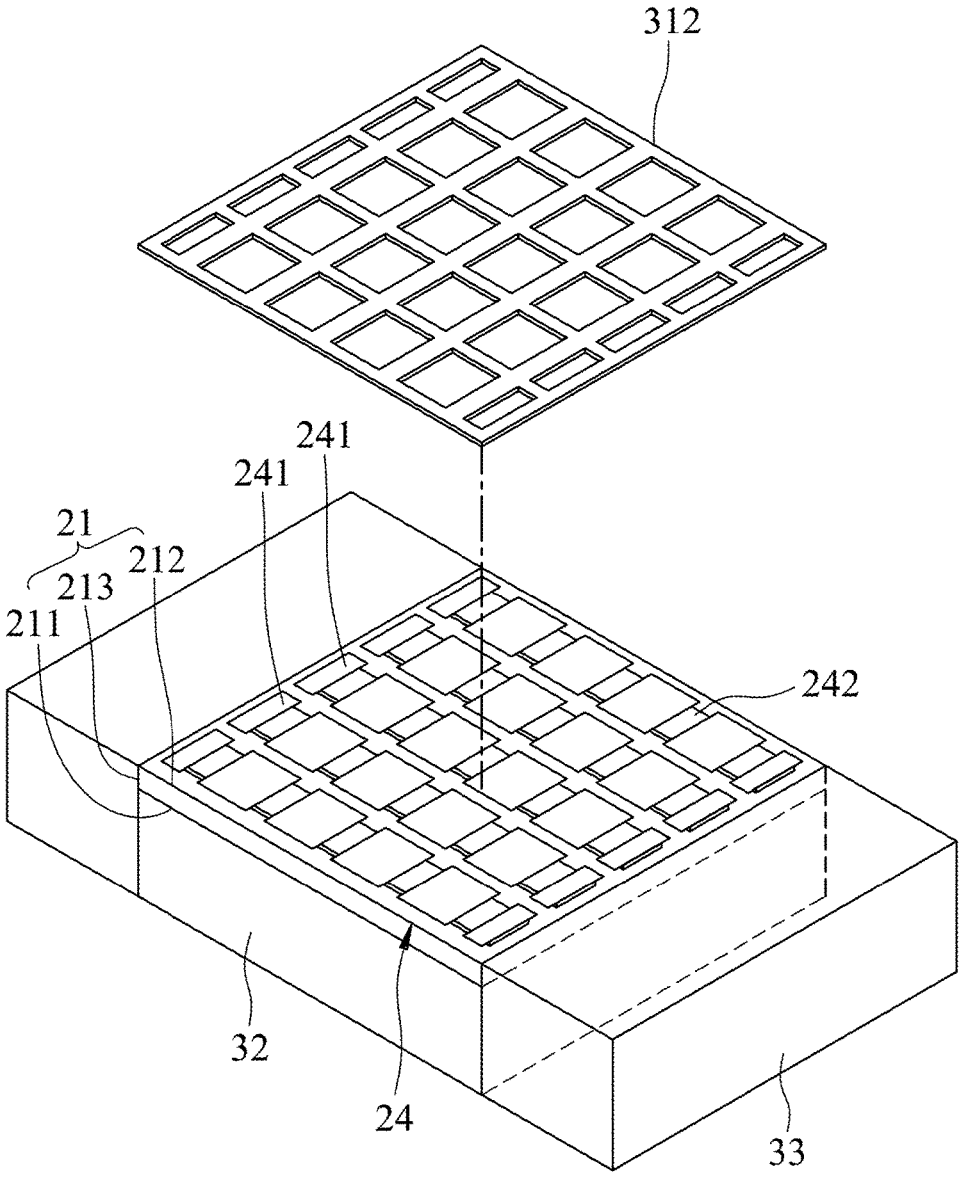
FIG. 8 is a schematic view showing a step of forming a plurality of the electrode elements in the second embodiment.

Referring to FIG. 7, in the conducting unit forming step 61, a plurality of the conducting units 23 are disposed on the first surface 211 of the substrate 21. Each of the conducting units 23 is located within a respective one of the substrate units 22 and includes two second electrode elements 231 that are separated from each other in the first direction (A). The conducting units 23 may be disposed by sputtering technique, evaporation technique, screen printing technique, etc. The second electrode elements 231 may be made of conductive materials, e.g., silver, copper or nickel-chromium alloy.

The mask disposing step 62 and the resistor unit depositing step 63 in the second embodiment are the same as the mask disposing step 11 and the resistor unit depositing step 12 in the first embodiment.

In the first dicing step 64, the substrate 21 is diced along the first imaginary dicing lines (X) to form a plurality of substrate blocks (not shown).

Figure 9:
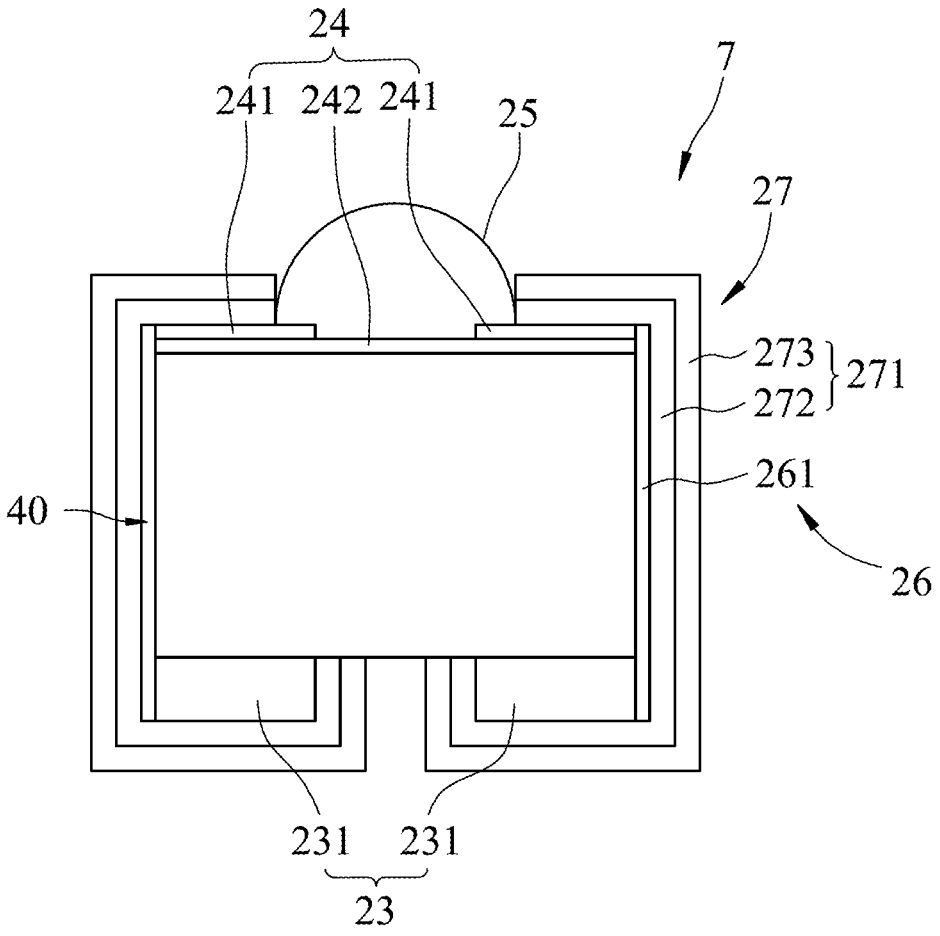
FIG. 9 is a side view of the thin film chip resistor device obtained by the second embodiment.

Referring to FIG. 9, in the connecting unit forming step 65, a plurality of connecting units 26 are formed on side surfaces of the substrate blocks. The connecting units respectively correspond to the conducting units 23 and respectively correspond to the resistor units 24. Each of the connecting units 26 includes two connecting elements 261, each of which interconnects a respective one of the first electrode elements 241 of one of the resistor units 24 to which the connecting unit 26 corresponds and a respective one of the second electrode elements 231 of one of the connecting units 23 to which the connecting unit 26 corresponds. The connecting units 26 may be formed by sputtering technique, evaporation technique, etc. The connecting elements 261 may be made of conductive materials, e.g., silver, copper or nickel-chromium alloy.

In the second dicing step 66, the substrate blocks are diced along the second imaginary dicing lines (Y) to form a plurality of chip resistor semi-products 40.

The plated unit forming step 67 in the second embodiment is similar to the plated unit forming step 14 in the first embodiment except that, in the plated unit forming step 67, the plated unit 27 is formed on a respective one of the chip resistor semi-products 40 such that each of the plated metal laminates 271 of the plated unit 27 covers and electrically contacts a respective one of the first electrode elements 241, the respective one of the connecting elements 261 and the respective one of the second electrode elements 231.

Similar to the first embodiment, the second embodiment may also include the step of forming the protective units 25. In the second embodiment, based on actual requirements, the step of forming the protective units 25 may be conducted before the first dicing step 64, between the first and second dicing steps 64, 66, or after the second dicing steps.

Note that either the first electrode elements 241 or the second electrode elements 231 of a respective one of the thin film chip resistor devices 7 can be used for electrically contacting the circuit board via a respective plated unit 27. In each thin film chip resistor device 7, when the second electrode elements 231 are used for electrical connection, a top surface of the protective unit 25 may be higher than a top surface of the plated unit 27.

It should be noted that, in the second embodiment, the first and second dicing steps 64, 66 may be omitted when manufacturing a single thin film chip resistor device 7 rather than multiple thin film chip resistor devices 7.

To sum up, with the use of the magnetic fixing member 32, and the first and second magnetic shadow masks 311, 312, the resistor units 24 can be formed with precise shapes and at precise locations.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A method for manufacturing a thin film chip resistor device, comprising the steps of:

disposing a magnetic fixing member on a first surface of a substrate, and disposing a magnetic shadow mask on a second surface of the substrate opposite to the first surface, such that the magnetic shadow mask detachably and fixedly contacts the second surface of the substrate by virtue of an attractive magnetic force between the magnetic fixing member and the magnetic shadow mask;

depositing at least one resistor unit on the second surface of the substrate with the use of the magnetic shadow mask, the resistor unit including two separated first electrode elements and a resistor element that electrically interconnects the first electrode elements; and forming a protective unit covering the resistor unit.

2. The method as claimed in claim 1, wherein:

in the depositing step, a plurality of the resistor units are deposited on the second surface of the substrate; and the method further comprises the steps of after the depositing step, dicing the substrate to form a plurality of chip resistor semi-products, each of the chip resistor semi-products including a respective one of the resistor units, and after the dicing step, forming a plated unit on the first electrode elements of the resistor unit of a respective one of the chip resistor semi-products, the plated unit including two plated metal laminates each covering and electrically contacting a respective one of the first electrode elements.

3. The method as claimed in claim 1 further comprising a step of forming a plated unit that includes two plated metal laminates, each of the plated metal laminates covering and electrically contacting a respective one of the first electrode elements.

4. The method as claimed in claim 1, wherein, in the disposing step, the magnetic fixing member, the magnetic shadow mask and the substrate are fixed with a fixture unit.

5. The method as claimed in claim 1, wherein the resistor element of the resistor unit is made of a material selected from a nickel-chromium alloy, a nickel-chromium-aluminum alloy, a manganese-aluminum alloy, and combinations thereof.

6. The method as claimed in claim 1, further comprising the steps of:

before the disposing step, forming a conducting unit on the first surface of the substrate, the conducting unit including two separated second electrode elements;

after the resistor unit depositing step, forming on a side surface of the substrate a connecting unit that includes two connecting elements, each of the connecting elements electrically interconnecting a respective one of the first electrode elements and a respective one of the second electrode elements; and forming a plated unit that includes two plated metal laminates, each of the plated laminates covering and electrically contacting the respective one of the first electrode elements, a respective one of the connecting elements and the respective one of the second electrode elements.

7. The method as claimed in claim 6, wherein:

the substrate is defined with a plurality of first imaginary dicing lines that are separated from one another along a first direction, and a plurality of second imaginary dicing lines that are separated from one another along a second direction and that intersect the first imaginary dicing lines to define a plurality of substrate units;

in the conducting unit forming step, a plurality of the conducting units are deposited on the first surface of the substrate, each of the conducting units being located within a respective one of the substrate units and including the second electrode elements aligned along the first direction; and in the resistor unit depositing step, a plurality of the resistor units are deposited on the second surface of the substrate within the substrate units respectively.

8. The method as claimed in claim 7, further comprising:

before the connecting unit forming step, a first dicing step of dicing the substrate along the first imaginary dicing lines to form a plurality of substrate blocks; and after the connecting unit forming step and before the plated unit forming step, a second dicing step of dicing the substrate blocks along the second imaginary dicing lines to form a plurality of chip resistor semi-products.

9. The method as claimed in claim 8, wherein:

in the connecting unit forming step, a plurality of the connecting units are formed on side surfaces of the substrate blocks, the connecting units corresponding respectively to the conducting units and corresponding respectively to the resistor units, each of the connecting elements of each of the connecting units interconnecting a respective one of the first electrode elements of one of the resistor units to which the connecting unit corresponds and a respective one of the second electrode elements of one of the conducting units to which the connecting unit corresponds; and in the plated unit forming step, the plated unit is formed on a respective one of the chip resistor semi-products such that each of the plated metal laminates of the plated unit covers and electrically contacts the respective one of the first electrode elements, the respective one of the connecting elements and the respective one of the second electrode elements.

10. A method for manufacturing a thin film chip resistor device, comprising the steps of:

disposing a magnetic fixing member on a first surface of a substrate, and disposing a magnetic shadow mask on a second surface of the substrate opposite to the first surface, such that the magnetic shadow mask detachably and fixedly contacts the second surface of the substrate by virtue of an attractive magnetic force between the magnetic fixing member and the magnetic shadow mask;

depositing at least one resistor unit on the second surface of the substrate with the use of the magnetic shadow mask, the resistor unit including two separated first electrode elements and a resistor element that electrically interconnects the first electrode elements; and forming a plated unit that includes two plated metal laminates, each of the plated metal laminates covering and electrically contacting a respective one of the first electrode elements.

11. The method as claimed in claim 10, wherein:

in the depositing step, a plurality of the resistor units are deposited on the second surface of the substrate; and the method further comprises the steps of after the depositing step, dicing the substrate to form a plurality of chip resistor semi-products, each of the chip resistor semi-products including a respective one of the resistor units, and after the dicing step, forming a plated unit on the first electrode elements of the resistor unit of a respective one of the chip resistor semi-products, the plated unit including two plated metal laminates each covering and electrically contacting a respective one of the first electrode elements.

12. The method as claimed in claim 10, wherein, in the disposing step, the magnetic fixing member, the magnetic shadow mask and the substrate are fixed with a fixture unit.

13. The method as claimed in claim 10, wherein the resistor element of the resistor unit is made of a material selected from a nickel-chromium alloy, a nickel-chromium-aluminum alloy, a manganese-aluminum alloy, and combinations thereof.

14. The method as claimed in claim 10, further comprising a step of forming a protective unit covering the resistor unit.

15. A method for manufacturing a thin film chip resistor device, comprising the steps of:

disposing a magnetic fixing member on a first surface of a substrate, and disposing a magnetic shadow mask on a second surface of the substrate opposite to the first surface, such that the magnetic shadow mask detachably and fixedly contacts the second surface of the substrate by virtue of an attractive magnetic force between the magnetic fixing member and the magnetic shadow mask; and depositing at least one resistor unit on the second surface of the substrate with the use of the magnetic shadow mask, the resistor unit including two separated first electrode elements and a resistor element that electrically interconnects the first electrode elements, wherein the resistor element of the resistor unit is made of a material selected from a nickel-chromium alloy, a nickel-chromium-aluminum alloy, a manganese-aluminum alloy, and combinations thereof.

16. The method as claimed in claim 15, wherein:

in the depositing step, a plurality of the resistor units are deposited on the second surface of the substrate; and the method further comprises the steps of after the depositing step, dicing the substrate to form a plurality of chip resistor semi-products, each of the chip resistor semi-products including a respective one of the resistor units, and after the dicing step, forming a plated unit on the first electrode elements of the resistor unit of a respective one of the chip resistor semi-products, the plated unit including two plated metal laminates each covering and electrically contacting a respective one of the first electrode elements.

17. The method as claimed in claim 15, wherein, in the disposing step, the magnetic fixing member, the magnetic shadow mask and the substrate are fixed with a fixture unit.

18. The method as claimed in claim 15, further comprising a step of forming a protective unit covering the resistor unit.

* * * * *